US009302890B1

(12) United States Patent
Vogt et al.

(10) Patent No.: US 9,302,890 B1
(45) Date of Patent: Apr. 5, 2016

(54) CRANE CONTROL SYSTEM AND METHOD

(71) Applicant: TNV, Inc., Charlotte, NC (US)

(72) Inventors: Paul E. Vogt, Harrisburg, NC (US); Douglas H. Taylor, Charlotte, NC (US); Gabriela R. Gunther, Huntersville, NC (US); An H. Nguyen, Matthews, NC (US); Matthew L. Megremis, Charlotte, NC (US)

(73) Assignee: TNV, INC., Charlotte, NC (US)

( * ) Notice: Subject to any disclaimer, the term of this patent is extended or adjusted under 35 U.S.C. 154(b) by 0 days.

(21) Appl. No.: 14/264,876

(22) Filed: Apr. 29, 2014

Related U.S. Application Data

(60) Provisional application No. 61/817,062, filed on Apr. 29, 2013.

(51) Int. Cl.
*B66C 13/18* (2006.01)
*B66C 15/04* (2006.01)

(52) U.S. Cl.
CPC ..... *B66C 13/18* (2013.01); *B66C 15/04* (2013.01)

(58) Field of Classification Search
CPC ..... B66C 13/18; B66C 15/04; B66C 13/22; B66C 13/40; B66C 13/46; B66C 15/06; B66C 15/065; B66C 2700/08; B66C 2700/084
See application file for complete search history.

(56) References Cited

U.S. PATENT DOCUMENTS

| | | | | |
|---|---|---|---|---|
| 5,297,019 | A * | 3/1994 | Zuehlke | B66C 13/18 700/1 |
| 6,744,372 | B1 * | 6/2004 | Shaw | B66C 13/44 212/276 |
| 8,618,949 | B2 * | 12/2013 | Maynard | B66C 15/045 212/276 |
| 8,738,175 | B2 * | 5/2014 | Cameron | B66C 13/46 700/213 |
| 2002/0024598 | A1 * | 2/2002 | Kunimitsu | B66C 13/46 348/159 |
| 2010/0044332 | A1 * | 2/2010 | Cameron | B66C 23/905 212/278 |
| 2013/0013251 | A1 * | 1/2013 | Schoonmaker | B66C 13/46 702/152 |
| 2013/0032561 | A1 * | 2/2013 | Singhose | B66C 13/40 212/273 |
| 2013/0299440 | A1 * | 11/2013 | Hermann | B66C 13/46 212/276 |

* cited by examiner

*Primary Examiner* — Nicholas Kiswanto
(74) *Attorney, Agent, or Firm* — Shumaker, Loop & Kendrick, LLP

(57) ABSTRACT

A crane control system including a control module configured to interface with a crane control system to intervene with crane movement to avoid a collision with an obstacle, plans stored in memory for use by the control module representing vertical elevation or elevation ranges of a job site and identifying obstacles, a plurality of crane configurations stored in memory, and a display interface displaying a selected plan, crane configuration and real-time crane position. A method for controlling crane movement to avoid a collision with an obstacle.

20 Claims, 3 Drawing Sheets

CRANE CONTROL SYSTEM AND METHOD

CROSS-REFERENCE TO RELATED APPLICATION

This Application claims the benefit of priority from U.S. App. No. 61/817,062 filed Apr. 29, 2013, the entirety of which is incorporated by reference herein.

TECHNICAL FIELD AND BACKGROUND OF THE INVENTION

The present invention relates generally to systems and methods for controlling crane movement to avoid collisions with obstacles, and more particularly, to systems and methods that utilize stored, site-specific elevation plan views of fixed obstacles and crane configurations to intervene with manually controlled crane movement to avoid collisions with obstacles.

Cranes are used in a wide range of industrial applications to carry loads from one location to another, among other purposes. Crane collisions with obstacles decrease productivity, increase production costs and endanger workers. Accordingly, systems have been developed to avoid collisions with other cranes and with obstacles. In automated systems without a crane operator, crane movements may be simulated and programmed in advance to avoid obstacles. In manual systems, crane positions may be monitored in real-time using lasers, GPS or other systems such that outputs from these devices trigger alarms to alert the operator of impending obstacles and collisions.

Neither of these conventional control systems make use of elevation details of obstacles at the site, nor include a controller that intervenes with joystick outputs at the earliest opportunity to control crane movement to avoid collisions. Therefore, it is one object of the present invention to provide an improved obstacle avoidance system and method for manually operated cranes.

BRIEF SUMMARY OF THE INVENTION

In a first embodiment, provided herein is a crane control system including a control module configured to interface/communicate with a crane control system to intervene with crane movement to avoid a collision with an obstacle, a plurality of plans stored in memory for use by the control module, each of the plurality of plans representing an overhead plan view of a job site including at least one obstacle therein at a predetermined elevation or elevation range, a plurality of crane configurations stored in memory for use by the control module, and a display interface configured to interface with the control module to display via a real-time visualization a selected one of the plurality of plans, a selected one of the plurality of crane configurations, and a real-time position of a crane.

In a further aspect, the control module may be configured to override joystick outputs to a programmable logic controller configured to send control signals to motor controllers of the crane control system.

In a further aspect, the crane control system may include a crane position sensing system for detecting and relaying positional information of a crane and components thereof to the programmable logic controller in real-time.

In a further aspect, the control module may select a plan from the plurality of plans corresponding to the real-time vertical position of the crane.

In a further aspect, the plans may be inputted as computer-aided design (CAD) files.

In a further aspect, the plurality of crane configurations may include one or more of crane type, model number, crane geometry, tooling geometry, folded and unfolded configurations, and loaded and unloaded configurations.

In a further aspect, the control module may be continuously updated with a selected one of the plurality of crane configurations based on the present state and position of a crane and components thereof.

In a further aspect, the control module may be configured to communicate with position sensing equipment of the crane control system to determine positional and velocity information of the crane and calculate the distance in real-time to an obstacle on the selected plan.

In a further aspect, the control module may be further configured to simultaneously or subsequently reduce signals sent to motor controllers to zero.

In a further aspect, the control module may be further configured to predict a path of a crane based on one or more of current crane movement, geometry and velocity.

In a further aspect, intervention may include slowing crane movement once a first predetermined threshold distance to an obstacle is reached and stopping crane movement entirely once a second predetermined threshold distance to an obstacle is reached based on one or more of crane velocity, crane deceleration potential, and weight of a load.

In a further aspect, the display interface may display directional information of a crane and in north, south, east, west and vertical directions, and wherein the directional information includes color coding indicating safe, approaching and imminent collision distances to an obstacle.

In a further aspect, the system may include a playback module for playing back recorded and logged crane movements and intervention events.

In a second embodiment, provided herein is a method for controlling crane movement including the steps of providing a control module configured to interface with a crane control system to control crane movement, selecting a plan from a plurality of plans stored in memory for use by the control module, each of the plurality of plans representing an overhead plan view of a job site including at least one obstacle therein at a predetermined elevation or elevation range, selecting a crane configuration from a plurality of crane configurations stored in memory for use by the control module, the crane configuration corresponding to the present state of a crane, providing a display interface configured to interface with the control module and visually displaying via a real-time visualization the selected one of the plurality of plans and the real-time position of the crane, and intervening with joystick outputs to a programmable logic controller of the crane control system to control crane movement to avoid a collision with an obstacle.

In a further aspect, the control module may communicate with a crane position sensing system to detect and relay positional information of the crane and components thereof to the programmable logic controller in real-time.

In a further aspect, the control module may select a plan from the plurality of plans corresponding to the real-time vertical position of the crane, and the control module may be continuously updated with a selected one of the plurality of crane configurations based on the present state and position of the crane and components thereof.

In a further aspect, the control module may communicate with position sensing equipment of the crane control system to determine positional and velocity information of the crane and calculate the distance in real-time to an obstacle on the selected plan.

In a further aspect, the control module may further predict a path of the crane based on one or more of current crane movement, geometry and velocity.

In a further aspect, the intervention step may include slowing crane movement once a first predetermined threshold distance to the obstacle is reached and stopping crane movement entirely once a second predetermined threshold distance to the obstacle is reached based on one or more of crane velocity, crane deceleration potential, and weight of a load.

Embodiments of the invention can include one or more or any combination of the above features and configurations.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

The systems and methods of the present invention are described herein in the general context of computer-executable instructions, for example program modules, executed on or executable by a computer. Program modules may include, but are not limited to, routines, programs, objects, components and data structures that perform particular tasks or implement particular abstract data types. Certain aspects of the present invention may be practiced in a distributed computing environment in which tasks may be performed by remote processing devices linked through a communications network. In a distributed computing environment, program modules may be located in both local and remote computer storage media including memory storage devices.

In certain aspects, processes and steps discussed herein may be realized as a set of instructions that reside within a computer readable memory and are executed by a processor of a computing system. When executed, the instructions cause the computer system to perform specific actions, or instruct other components within the system to perform specific actions. Computer systems described herein may include one or more central processors coupled with a bus for communicating information and instructions. The computer system may include data storage features such as a computer usable volatile memory unit and computer usable data storage device for storing information and/or computer executable instructions.

Figure 1:
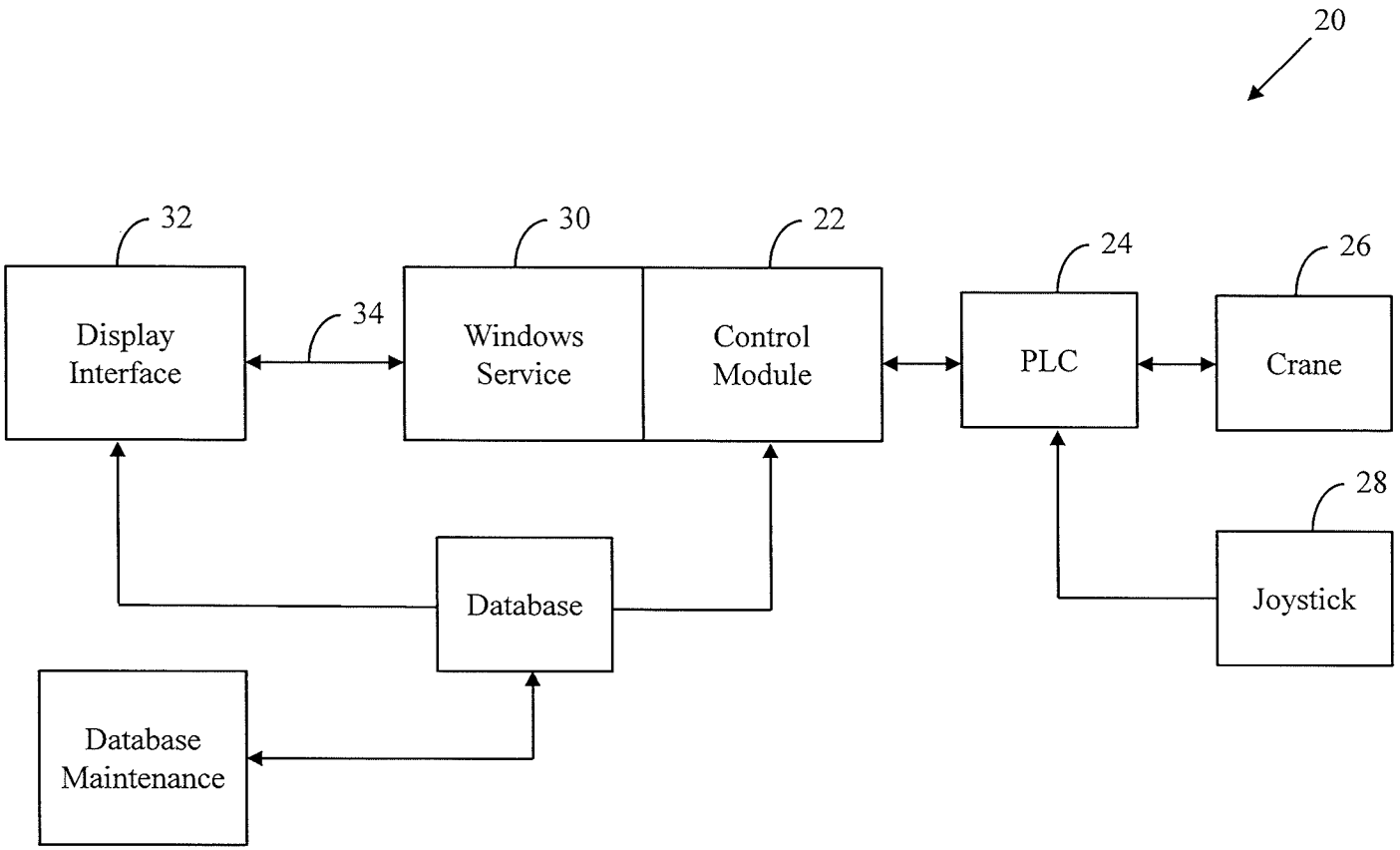
FIG. 1 is a block diagram illustrating the general system architecture of a control system according to a preferred embodiment of the invention.

Referring to FIG. 1, a preferred embodiment of a control system for avoiding crane collisions is shown generally at reference numeral 20. The system 20 generally includes a control module 22 configured to interface with any form of conventional crane control system generally including a Programmable Logic Controller (PLC) 24, one or more motor controllers, and a crane position sensing system. Known to those skilled in the art, a motor controller generally functions to control the performance of an electric motor for driving crane movement, such as movement of the crane 26 and components thereof along x, y and z-axes, rotational movement, etc. The term "performance" as used herein may include, but is not limited to, starting/stopping the motor(s), forward/reverse rotation, motor speed, regulating torque, etc.

Also known to those skilled in the art, the PLC 24 functions to receive outputs from a user operated joystick 28 or other device for manually controlling the movement of the crane 26. Upon receiving inputs from the joystick 28, the PLC 24 sends control signals to the motor controllers, which in turn control the motors. The crane position sensing system may include any conventional position sensing system for detecting and relaying the position of the crane and components thereof to the PLC 24 in real-time, for example, laser, GPS, RFID and vision-based position sensing systems.

The control module 22 interfaces with a Dynamic Link Library (DLL) accessed by a Windows™ Service 30 or like program known to those skilled in the art. The control module 22 holds job site specific plans and crane configurations in memory as resources for use by the control module 22. The term "plan" as used herein means an overhead plan view of a job site including the obstacles therein at a predetermined elevation or elevation range. Because obstacles may only be present at certain elevations, multiple plans taken at different elevations or elevation ranges are stored in memory, and the appropriate plan is selected for use by the control module 22 based on the current elevation of the crane.

For example, walls associated with storage bays may be present as obstacles only at low elevations within the total vertical range of movement of the crane. When the crane 26 is at a specific elevation, the control module 22 selects the plan from the DLL that corresponds to that specific elevation or elevation range and uses the plan to identify obstacles and override the manual crane control if necessary to avoid a collision. As the crane moves vertically, the control module 22 selects the appropriate plan corresponding to the real-time vertical position of the crane 26. Plans may be created by the crane control service provider or other using conventional mapping techniques, and inputted as CAD files or like files into the control module memory.

The control module 22 further utilizes various crane configurations stored in memory as resources. Crane configurations may include, but are not limited to, crane type, model number, crane geometry, tooling geometry, folded/unfolded configurations, loaded/unloaded configurations, performance parameters, etc. Crane configurations are pre-loaded, and the appropriate crane configuration is selected for use by the control module 22 depending on the specific crane type and state of the crane. The plans and crane configurations are used cooperatively and simultaneously by the control module 22. Thus, the control module 22 is continuously updated with the appropriate plan and crane configuration corresponding to the present state and position of the crane and components thereof.

The control module 22 further interfaces with the existing position/velocity sensing equipment of the crane. The sensing equipment relays x, y and z-axis positional information to the controller as well velocity information and rotational information, among other information. Sensing equipment may further include an encoder known to those skilled in the art. The control module 22 interfaces with the sensing equipment to determine the position/velocity of the crane in order to calculate the distance in real-time to obstacles on the selected plan. Based on the crane configuration, distance to obstacles, crane velocity as well as other parameters, the control module calculates and predicts the distance to obstacles and intervenes (e.g., overrides the joystick outputs) as necessary to avoid collisions with obstacles.

Intervention may take place at the joystick output to the PLC 24, so as to intervene at the earliest possible time and prior to output signals being sent to the motor controllers. As a failsafe, control module intervention may also include simultaneously or subsequently reducing signals at the motor controllers to zero. Intervention may alternatively occur between the PLC 24 and the motor controllers.

The control module 22 creates a predicted path of the crane based on current crane movement, geometry and velocity, and a calculation module performs a real-time calculation of the distance to an obstacle. Based on the calculated distance to an obstacle, the control module 22 intervenes to block, stop or override the output signals from the operator joystick to slow or stop the crane 26 as necessary to avoid a collision. The degree of intervention or speed of reduction may be based on a scale from 0-100, for example, with zero being contact with an obstacle and 100 being the beginning of control module intervention. Intervention may include slowing the crane once a first predetermined threshold is reached, and stopping movement entirely once a second predetermined threshold is reached. The percent of intervention, manner of intervention, and thresholds may be selected, customized and tailored based on the velocity of the crane, deceleration potential of the crane, weight of the load, user preferences, etc.

Figure 2:
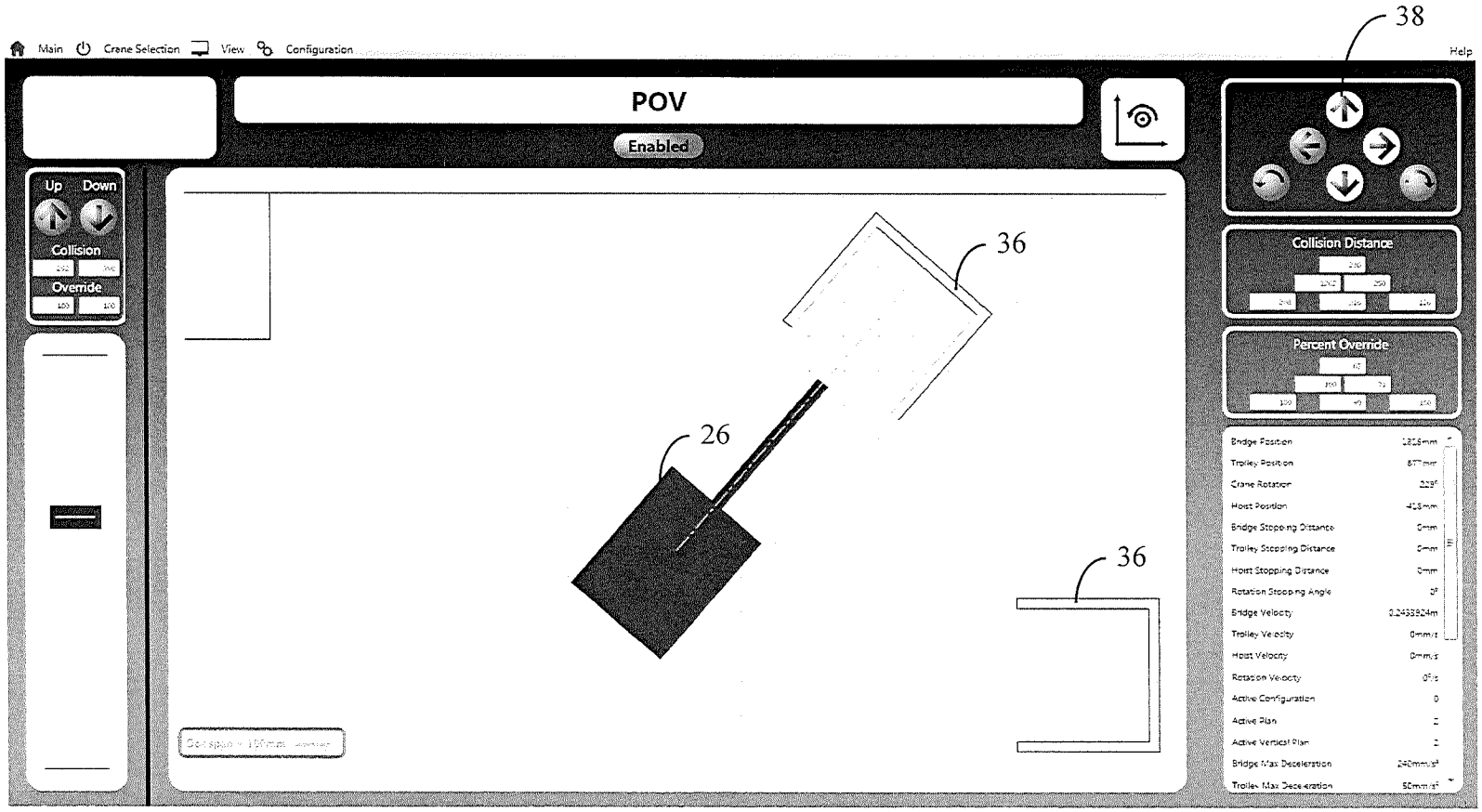
FIG. 2 is a screen capture taken from the crane operator display interface showing a selected plan of an elevation or elevation range and real-time position of the crane.

Referring to FIG. 2, the control system 20 further interfaces with a display interface 32 through a TCP/IP socket or named pipe (see FIG. 1 at reference numeral 34). The interface 32 is configured to display, via a real-time visualization (e.g., a model or simulation), the current plan, crane configuration and real-time position of the crane. The center of the display screen shows the current plan, obstacles 36 (e.g., bay walls) at that particular elevation or elevation range, and real-time position of the crane 26. Directional information is shown in the upper right-hand corner of the screen capture, with collision distances in the north, south, east and west directions represented by the directional arrows 38. The directional arrows 38 may be highlighted a certain color based on the collision distance in that particular direction. For example, a "safe" collision distance in a particular direction may cause the directional arrow to display 'green', an "approaching" obstacle may cause the directional arrow to display 'yellow', and an "imminent" obstacle may cause the directional arrow to display 'red'. Alternative indicia may be used to serve the same function.

Collision distances and the percent of override corresponding to the north, south, east and west directional errors may also be displayed on the interface for each direction, as shown in the box below the directional arrow box. The interface may further display to the crane operator velocity, acceleration, deceleration, crane component position, and other crane performance, as well as the current plan being viewed and plan parameters, etc., as shown in the box in the lower right-hand corner of FIG. 2. The interface may further display the real-time vertical position of the crane and distances to collisions in the vertical directions. Like the north, south, east and west directional arrows, the vertical "up" and "down" directional arrows may be highlighted a predetermined color based on the vertical distance to an obstacle above or below the crane. The interface may further display the real-time vertical position of the crane 26 within the total vertical range of movement, as shown in the box in the lower left-hand corner of the screen capture.

The interface may further display the predicted path of the crane based on the current velocity and direction of the crane. The predicted path of the crane may be displayed as a virtual extension of the crane along present direction of movement, and the extension may increase/decrease as the crane velocity increases/decreases, respectively. The current direction of travel may be indicated by a dashed line, as shown in FIG. 2.

It should be understood that the user interface shown in FIG. 2 is only one example of a user interface, and that the interface may be customized with respect to the format and information displayed. The user interface may be displayed on a PC, tablet, smart phone, joystick controller or other device. It should be understood that the user interface is there to provide information to the crane operator, and is not essential to implement the control system according to the present invention.

Figure 3:
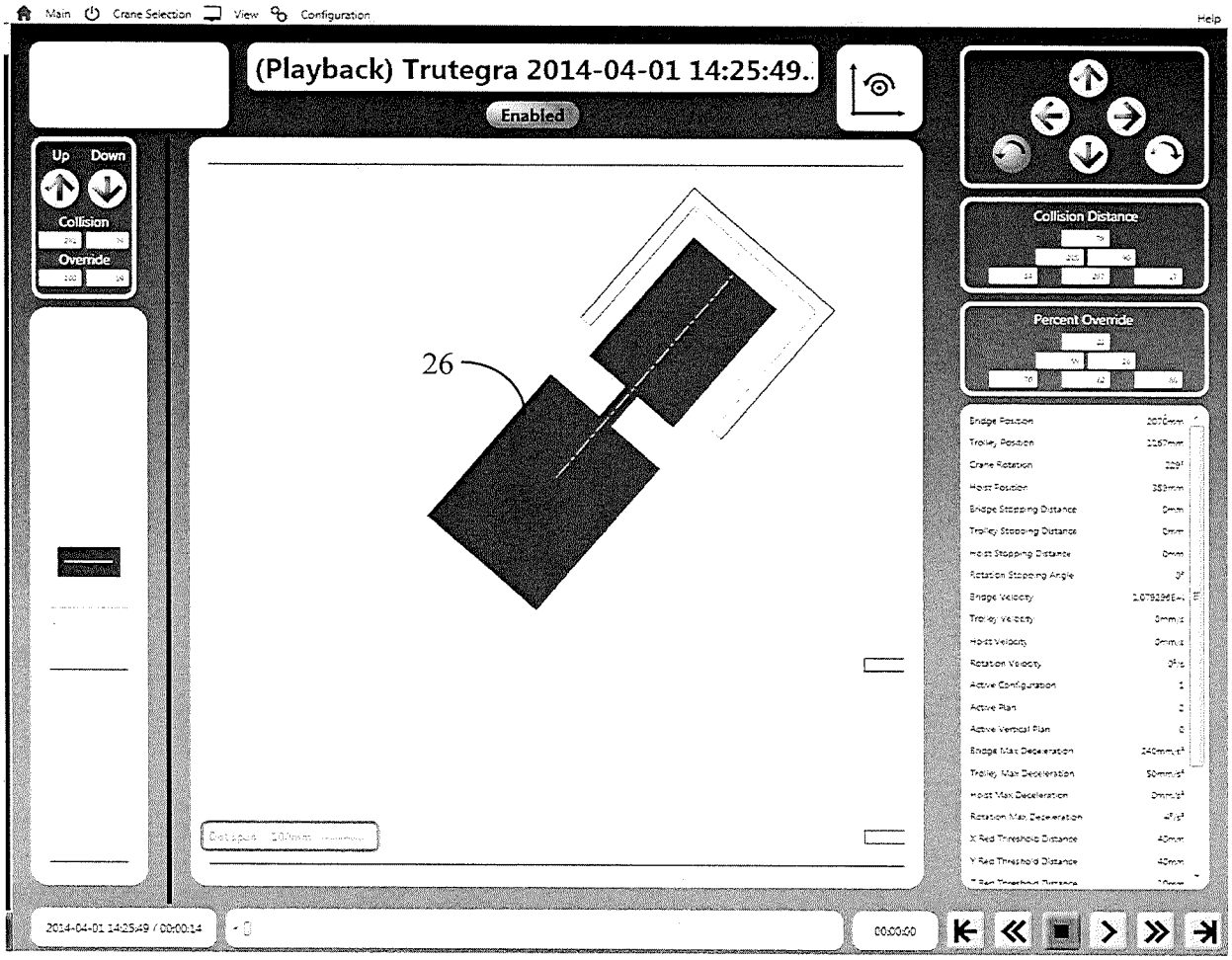
FIG. 3 is a screen capture taken from a display interface showing the playback of recorded crane movement.

Referring to FIG. 3, crane movement may be recorded and logged to a data file for playback through the display interface or other interface. The system may be configured to automatically collect, process and store data representing crane movement and operation for later retrieval and analysis. In general, the control module may process and input data associated with collision intervention/avoidance events. Stored events may be time and date stamped indicating the time at which the event/intervention occurred.

In a further aspect, the control system 20 may be disabled as needed, for example, between obstacle changes and plan imports.

The foregoing description provides embodiments of the invention by way of example only. It is envisioned that other embodiments may perform similar functions and/or achieve similar results. Any and all such equivalent embodiments and examples are within the spirit and scope of the present invention.

What is claimed is:

1. A crane control system, comprising:

a control module configured to interface with a crane control system to intervene with crane movement to avoid a collision with an obstacle;

a plurality of plans collectively representing a total vertical elevation of a job site and stored in memory for use by the control module, each of the plurality of plans individually representing a predetermined portion of the total vertical elevation of the job site and any obstacles disposed therein, the control module further configured to select a plan from the plurality of plans that corresponds in vertical elevation to a real-time vertical position of a crane;

a plurality of crane configurations stored in memory for use by the control module; and a display interface configured to interface with the control module to display via a real-time visualization a selected one of the plurality of plans, a selected one of the plurality of crane configurations, and the real-time position of the crane.

2. The system of claim 1, wherein the control module is configured to override joystick outputs to a programmable logic controller configured to send control signals to motor controllers of the crane control system.

3. The system of claim 2, wherein the crane control system comprises a crane position sensing system for detecting and relaying positional information of a crane and components thereof to the programmable logic controller in real-time.

4. The system of claim 1, wherein the control module selects a plan from the plurality of plans corresponding to the real-time vertical position of the crane.

5. The system of claim 1, wherein the plurality of plans are inputted as computer-aided design files.

6. The system of claim 1, wherein the plurality of crane configurations comprise one or more of crane type, model number, crane geometry, tooling geometry, folded and unfolded configurations, and loaded and unloaded configurations.

7. The system of claim 1, wherein the control module is continuously updated with a selected one of the plurality of crane configurations based on the present state and position of a crane and components thereof.

8. The system of claim 1, wherein the control module is configured to communicate with position sensing equipment of the crane control system to determine positional and velocity information of the crane and calculate the distance in real-time to an obstacle on the selected plan.

9. The system of claim 1, wherein the control module is further configured to simultaneously or subsequently reduce signals sent to motor controllers to zero.

10. The system of claim 1, wherein the control module is further configured to predict a path of a crane based on one or more of current crane movement, geometry and velocity.

11. The system of claim 1, wherein intervention includes slowing crane movement once a first predetermined threshold distance to an obstacle is reached and stopping crane movement entirely once a second predetermined threshold distance to an obstacle is reached based on one or more of crane velocity, crane deceleration potential, and weight of a load.

12. The system of claim 1, wherein the display interface displays directional information of a crane and in north, south, east, west and vertical directions, and wherein the directional information includes color coding indicating safe, approaching and imminent collision distances to an obstacle.

13. The system of claim 1, further comprising a playback module for playing back recorded and logged crane movements and intervention events.

14. A method for controlling crane movement, comprising the steps of:

providing a control module configured to interface with a crane control system to control crane movement;

selecting a plan from a plurality of plans collectively representing a total vertical elevation of a job site and stored in memory for use by the control module, each of the plurality of plans individually representing a predetermined portion of the total vertical elevation of the job site and any obstacles disposed therein, the control module further configured to select a plan from the plurality of plans that corresponds in vertical elevation to a real-time vertical position of a crane;

selecting a crane configuration from a plurality of crane configurations stored in memory for use by the control module, the crane configuration corresponding to the present state of the crane;

providing a display interface configured to interface with the control module and visually displaying via a real-time visualization the selected one of the plurality of plans and the real-time position of the crane; and intervening with joystick outputs to a programmable logic controller of the crane control system to control crane movement to avoid a collision with an obstacle.

15. The method of claim 14, wherein the control module communicates with a crane position sensing system to detect and relay positional information of the crane and components thereof to the programmable logic controller in real-time.

16. The method of claim 14, wherein the control module selects a plan from the plurality of plans corresponding to the real-time vertical position of the crane, and the control module is continuously updated with a selected one of the plurality of crane configurations based on the present state and position of the crane and components thereof.

17. The method of claim 14, wherein the control module communicates with position sensing equipment of the crane control system to determine positional and velocity information of the crane and calculate the distance in real-time to an obstacle on the selected plan.

18. The method of claim 14, wherein the control module further predicts a path of the crane based on one or more of current crane movement, geometry and velocity.

19. The method of claim 14, wherein the intervention step comprises slowing crane movement once a first predetermined threshold distance to the obstacle is reached and stopping crane movement entirely once a second predetermined threshold distance to the obstacle is reached based on one or more of crane velocity, crane deceleration potential, and weight of a load.

20. The method of claim 14, wherein the display interface displays directional information of the crane and in north, south, east, west and vertical directions, and wherein the directional information includes color coding indicating safe, approaching and imminent collision distances to the obstacle.

* * * * *